US005620269A

United States Patent [19]

Gustafson

[11] Patent Number: 5,620,269

[45] Date of Patent: Apr. 15, 1997

[54] PRINT MEDIA TRANSPORT APPARATUS FOR MOVING PRINT MEDIA THROUGH A PRINTER FROM A HIGH VOLUME INPUT TRAY ACCESSORY

[75] Inventor: Michael Gustafson, San Diego, Calif.

[73] Assignee: Hewlett-Packard Company, Palo Alto, Calif.

[21] Appl. No.: 373,829

[22] Filed: Jan. 17, 1995

[51] Int. Cl.[6] ..... B41J 11/58

[52] U.S. Cl. ..... 400/624; 347/104; 347/108; 400/691

[58] Field of Search ..... 400/624, 629, 400/689, 690, 690.4, 691, 693; 347/101, 104, 105, 108; 355/308, 309; D18/39, 44, 45, 46, 47, 48, 49, 50, 54, 55; 312/208.1, 208.2; 271/9.04, 9.11, 9.13, 109

[56] References Cited

U.S. PATENT DOCUMENTS

| | | | |
|---|---|---|---|
| D. 306,872 | 3/1990 | Kapp et al. | D18/49 |
| D. 368,273 | 3/1996 | Dubson | D18/49 |
| 4,733,310 | 3/1988 | Kapp et al. | 355/311 |
| 4,760,492 | 7/1988 | Walsh | 400/691 |
| 4,781,480 | 11/1988 | Kikuchi et al. | 400/691 |
| 4,840,344 | 6/1989 | Moroe | 312/223.3 |
| 4,842,261 | 6/1989 | Thogersen et al. | 400/629 |
| 4,958,823 | 9/1990 | Iwaki et al. | D18/47 |
| 5,150,166 | 9/1992 | Matsuura et al. | 355/308 |
| 5,479,199 | 12/1995 | Moore et al. | 347/102 |

*Primary Examiner*—David A. Wiecking

[57] ABSTRACT

The invention relates to a high capacity paper tray cabinet and transport apparatus for transporting sheets of paper or other print media from the high volume tray to a printer which sits on top of the cabinet. A pivotally mounted convex paper guide and a pivotally mounted concave paper guide housing at the rear of the cabinet define a paper path therebetween which extends generally vertically and then curves to a generally horizontal direction for feeding paper to the single sheet paper path in the printer through an access aperture in the rear wall of the printer. Paper drive rollers and an electrical resistance paper pre-heater are mounted in the apparatus proximate the discharge end of the paper path such that pre-heated paper can be immediately fed at the appropriate location of the paper path in the printer, preferably an inkjet printer.

10 Claims, 3 Drawing Sheets

PRINT MEDIA TRANSPORT APPARATUS FOR MOVING PRINT MEDIA THROUGH A PRINTER FROM A HIGH VOLUME INPUT TRAY ACCESSORY

BACKGROUND OF THE INVENTION AND PRIOR ART

The present invention relates to computer driven printers and, more particularly, to increasing the capacity of print media supply for an inkjet printer. For ease of reference, instead of the term print media, the term paper will be used herein and is intended to encompass all forms of print media including paper, transparencies, vellum, etc. One example of prior art printer with which the present invention is useful is the Hewlett Packard inkjet color printer Model 1200 which has standard vertically spaced paper input and output trays on the front of the printer as shown and claimed in co-pending application Ser. No. 08/055,650 filed Apr. 30, 1993 and assigned to the assignee of the present invention.

The standard paper input tray shipped with the printer has a capacity of about 180 sheets of paper resulting in frequent print stoppage for replenishment of the paper supply in the input tray during high volume printing. It is desired to reduce the amount of printer downtime due to reloading of the input tray.

Ordinary paper trays comprise rectangular bins having vertical walls with multiple springs and pressure plates to urge the stack of paper upwardly against drive rollers to permit reliable paper feeding. Another type of tray, particularly useful with the present invention, has a slanted wall at the paper output end which is designed to permit the surface tension of the paper in the tray to be broken with the paper being physically stacked in the tray at an angle as disclosed in U.S. Pat. No. 5,377,969, and owned by BDT Buero Datentechnik GmbH. Trays of this type employ an articulated paper pusher arm mounted in either the paper tray or the printer housing which urges the top sheet of paper in the tray toward the printer paper feed mechanism.

Also, as is well known, inkjet printers apply wet ink to the paper or other print medium which is preheated before application of the ink to prevent or at least minimize shrink banding of the paper. Accordingly, the HP 1600C color inkjet printer referred to above incorporates a paper pre-heater in the path of movement of the paper from the standard input tray, the pre-heater being located immediately before the paper reaches the print zone.

A primary objective of the present invention is to efficiently guide and transport paper from a relatively large capacity (as compared with the standard input tray) auxiliary paper input tray to the print zone of known printers without substantial modification of the printer design.

A second objective of the present invention is to use a portion of the known printer's paper transport and guide means in the paper transport path which extends from an existing manual single sheet paper feed input slot to the print zone to guide the paper to the print zone.

A third objective is to preheat paper fed from an auxiliary paper tray at a location proximate the print zone.

SUMMARY OF THE INVENTION

The present invention provides a print media transport apparatus for transporting sheets of print media from a high volume auxiliary media input tray and for introducing said sheets into a printer media transport path extending from an individual sheet reception slot to a print zone of a printer, said apparatus comprising:

a) a tray cabinet having an upper surface for supporting a printer thereon and having a receptacle in said cabinet for receiving a print media tray moveable into and out of said cabinet along a path extending from a first side of said cabinet toward a second side of said cabinet;

c) means in said cabinet for moving individual print media sheets from the top of a stack of sheets in said tray toward said second side of said cabinet;

d) a convex print media guide moveable between an operative position in which said guide extends upwardly from said cabinet and an open position in which said convex guide extends generally in the direction of movement of said print media tray, said guide being movably connected to said cabinet proximate said second side of said cabinet;

e) a print media guide housing moveable between an operative position in which said housing extends upwardly from said cabinet and an open position in which said housing extends generally in the direction of movement of said print media tray, said housing being movably connected to said cabinet at said second side, said housing having a concave print media guide surface therein spaced from said convex print media guide, said convex guide and said concave housing surface, when in operative position, defining a curved print media path therebetween terminating at a discharge end, said housing substantially enclosing said print media guide;

f) means for moving individual sheets of print media along said print media path; and g) a print media pre-heater affixed to one of said guide and said housing proximate said print media discharge end.

DESCRIPTION OF THE PREFERRED EMBODIMENT

Figure 1:
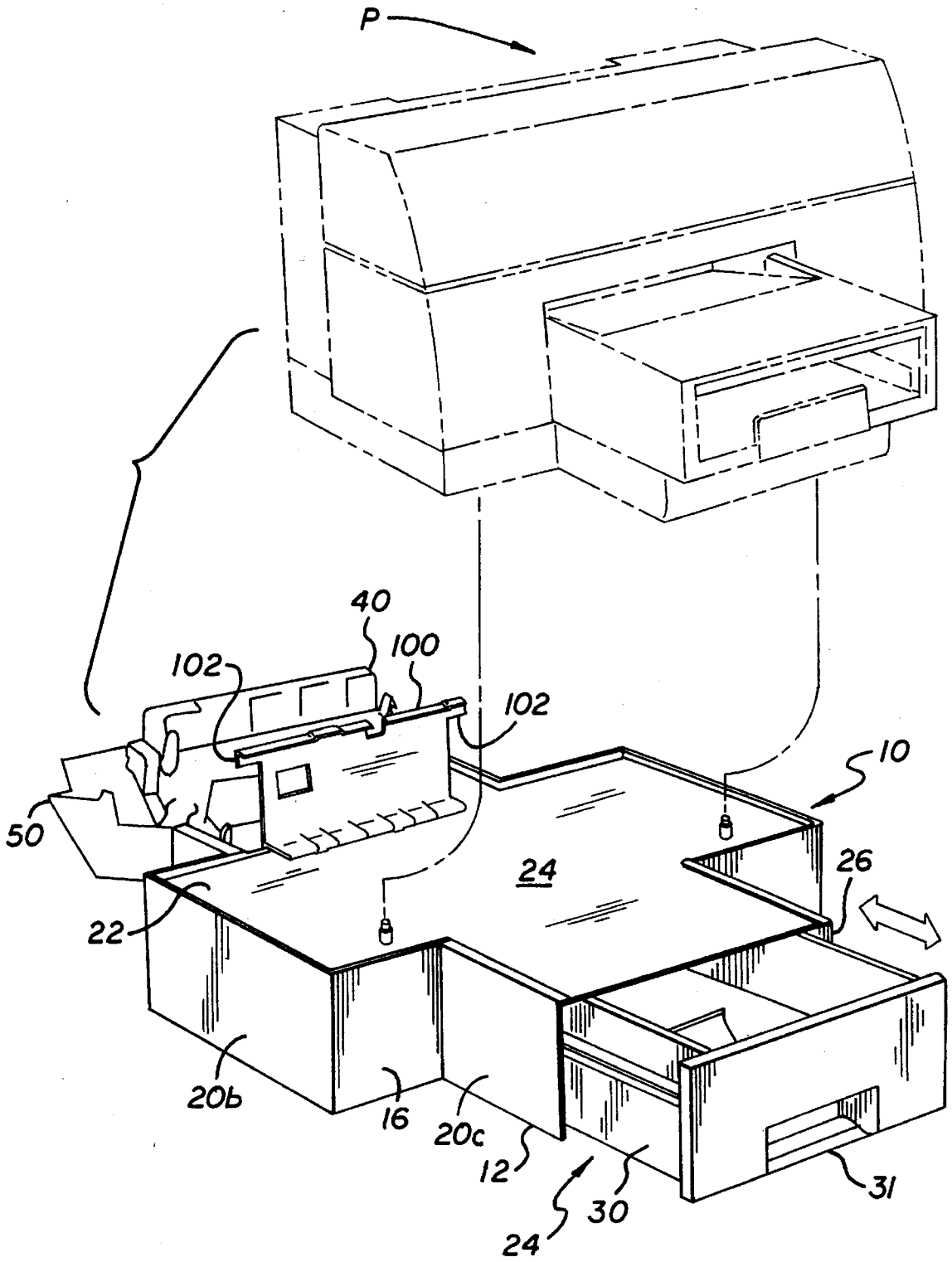
FIG. 1 is an exploded perspective view of a paper transport apparatus for feeding print media to the transport path in an ink jet printer which extends from an individual sheet reception slot and in which the printer is supportable on the apparatus.

As seen in FIG. 1 the print media transport apparatus of the present invention comprises a generally rectangular tray cabinet 10 having forwardly and rearwardly extending narrow sections 12, 14. Cabinet 10 also has vertically extending front, rear and side walls 16, 18, 20*a*, 20*b*, 20*c* and a substantially flat upper wall 24 which provides a flat surface for supporting a printer P (shown in phantom) thereon. The front side of the cabinet has an opening 26 which receives a print media tray 30 moveable into and out of the cabinet along a path which extends generally from the front or first side of the cabinet toward the rear or second side of the cabinet as shown.

Although the paper tray 30 itself forms no part of the present invention, the tray has a handle 31 and an upwardly inclined rear wall 32 against which the uppermost sheet of paper is pushed by a power-driven roller 34 mounted on the end of an articulating arm 36 which is in turn pivotally attached to the underside of the upper wall 24 of the cabinet. Powered rotation of the roller 34 urges the uppermost sheet of paper against the angularly disposed rear wall 32 of the tray such that the paper enters a paper path PP, indicated by the dashed line and to be described below, for transport to the printer. The articulating arm 36 is designed such that angular passive sheet separation is achieved when the roller drive force on the top sheet of the paper is greater than the frictional resistance force imposed by the angular wall 32. Trays of this type reliably can hold various paper weights in quantities ranging from 500 to 1000 sheets or more depending on configuration.

Figure 2:
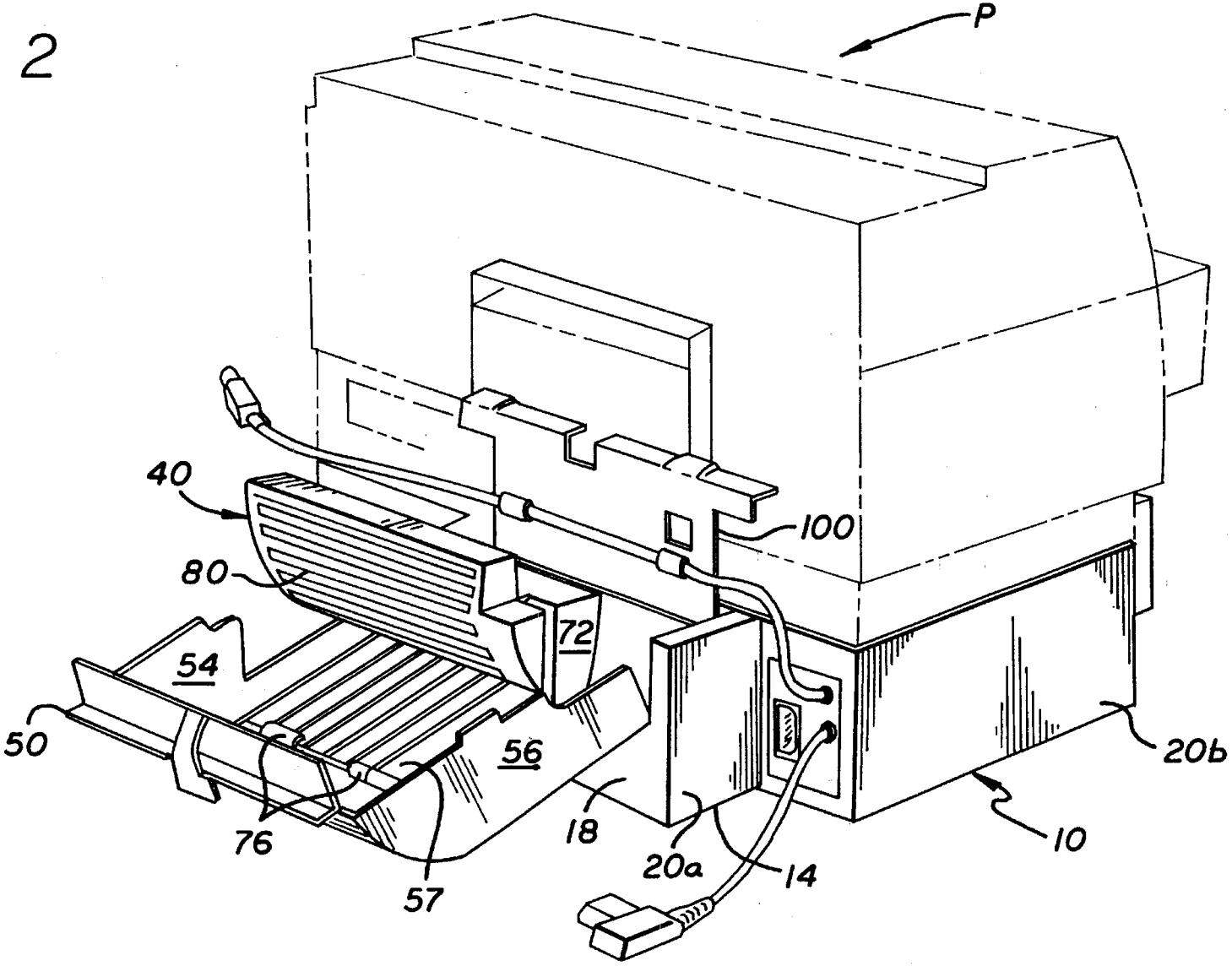
FIG. 2 is a rear perspective view showing pivotally mounted housing and convex media guides which define a paper path therebetween shown in their open or inoperative positions.
Figure 3:
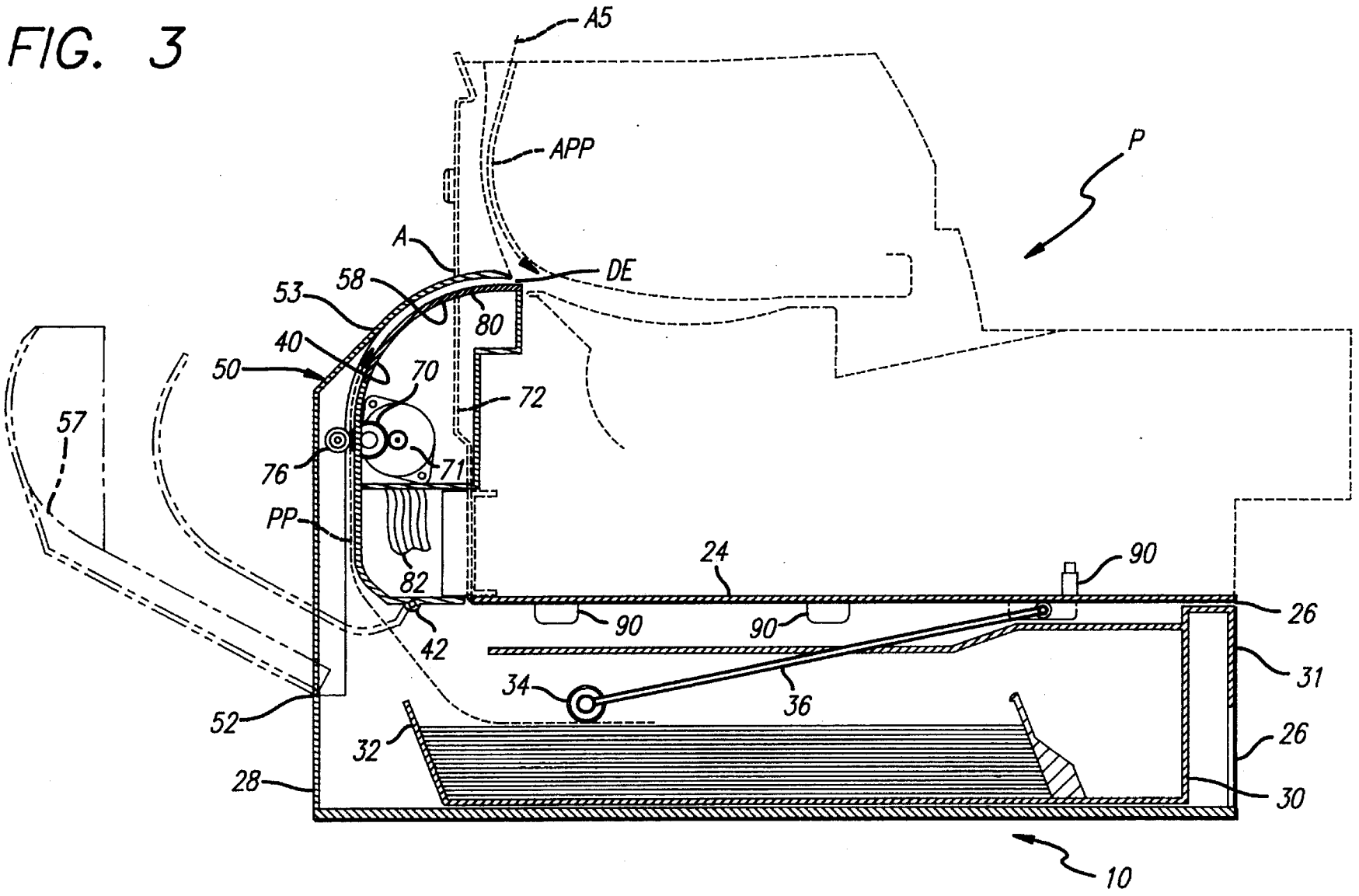
FIG. 3 is a cross-sectional side elevation view of the apparatus.

Contained within the tray cabinet 10 and pivotally affixed thereto at either side wall 20*a* of the rearwardly extending narrow section 14 is a convex print media guide 40 moveable between an operative position shown in solid lines in FIGS. 2 and 3 and an open or access position shown in solid lines in FIG. 1 in which the convex guide 40 is pivotally moved to a position in which it extends generally horizontally, i.e., generally in the direction of movement of the print media tray 30. The pivotal connections of the guide 40 to the cabinet side walls 20*a* afford movement of the guide about a first axis 42 proximate the second or rear side of the cabinet.

Also shown in the open or access inoperative position in FIGS. 1 and 2 is a print media guide housing 50 which is also pivotally affixed to the side walls 20*a* of the narrow section 14 at the rear of the cabinet 20 for movement about a second pivot axis 52 between the open position shown in FIGS. 1 and 2 to the closed position seen in FIG. 3. The print media guide housing 50 is a molded plastic member having a rear wall 53, a pair of side walls 54, 56 and a plurality of spaced paper guide rails 57 which together provide a concave print media guide surface 58 thereon which, in operative position, is spaced from the convex print media guide 40 such that the convex print media guide and concave housing surface when in operative position, together define the curved print media path PP therebetween. Paper or other print media moving through the paper path is PP discharged in a generally horizontal direction at the discharge end DE of the print path. The housing 50 when in closed position, substantially encloses the print media guide 40 which is nested therein.

A power-driven paper pickup roller 70 or series of rollers aligned on a common axis as well as a roller drive motor 71, is mounted in an enclosure 72 on the interior side of the convex print media guide 40 in the location best seen in FIG. 3. Enclosure 72 is also provided with an access door, not shown, for accessing the motor and drive roller(s) 70 when guide 40 is in its open or inoperative position. In opposed relationship to the powered roller(s) 70 are one or more spring biased pinch rollers 76 mounted for rotation about a common axis on the print media guide housing 50 such that the leading edge of a sheet of paper moved from the stack is acquired by the opposed pickup drive and pinch rollers 70, 76 for continuation of its movement along the paper path PP.

Due to the fact that the invention is particularly suitable for use with inkjet printers wherein paper curling is a problem due to the application of liquid ink, an electrical resistance pre-heater 80 is mounted near the discharge end DE of the paper path, preferably on the convex print media guide 40 adjacent the motor and drive roller enclosure 72 as shown. Alternatively, the pre-heater 80 could be mounted on the concave inner wall of the print media guide housing 50.

Although the configuration of the cabinet 20 including the size and shape of its upper printer support surface and the dimensions and position of the discharge end DE of the paper path and its orientation relative to the upper surface of the cabinet will vary depending upon the specific printer P with which the cabinet is to be used, indexing means 90 are provided on the cabinet upper surface which may take the form of indentations at the locations at which the support feet of the printer are to be located. Accordingly, the printer P will be properly positioned at all times on the upper surface of the cabinet when its feet are located in the detents. In the embodiment shown which is intended for use with a Hewlett-Packard 1600C color inkjet printer, the apparatus is dimensioned to discharge paper or other print media horizontally into the lower portion of auxiliary sheet paper path APP of the printer indicated by a dashed line through an aperture A in the rear wall of the printer specially provided for this purpose. Ordinarily, the printer receives a continuous supply of paper from a paper tray mounted on the front of the printer but the printer also has an auxiliary input slot AS at the top of the printer for receiving individual sheets hand-fed to the printer downwardly in a generally vertical direction. When the auxiliary paper slot AS is used, the sheets automatically move downwardly through the printer auxiliary paper path APP which changes direction to a generally horizontal orientation at the location shown. The discharge end DE of the paper path of the print media transport apparatus of the present invention introduces paper into the auxiliary paper path APP at the location shown in the transition from its vertical to generally horizontal direction. Additional indexing means 90 in the form of vertically oriented pins extending upwardly from the upper wall support surface 22 of the cabinet into receptacles in the underside of the printer may also be provided for proper orientation of the printer relative to the print media transport apparatus.

The type and configuration of the electrical resistance paper pre-heater 80 can vary but, in general, the pre-heater will comprise a serpentine electrically conductive strip bonded to a flexible plastic substrate which, together with electrical connection leads 82 for the motor 71 and heater 80, can be easily mounted on the convex print media guide 40.

An upstanding rigid flange 100 is rigidly affixed in the location best seen in FIG. 1 to the cabinet 20 to provide side-to side alignment between the printer chassis and the sheet feeder. Flange 100 also constitutes a stop against which the convex print media guide 40 and motor housing abuts when in its operative position. A horizontally extending tab or tabs 102 on the flange 100 also provide a stop surface against which the print media guide housing 50 side walls abut when in operative position.

Persons skilled in the art will readily appreciate that various modifications can be made from the preferred embodiment thus the scope of protection is intended to be defined only by the limitations of the appended claims.

I claim:

1. A print media transport apparatus for transporting sheets of print media from a high volume auxiliary media input tray and for introducing said sheets into a printer media transport path extending from an individual sheet reception slot to a print zone of a printer, said apparatus comprising:

a) a tray cabinet having an upper surface for supporting a printer thereon and having a receptacle in said cabinet for receiving a print media tray moveable into and out of said cabinet along a path extending from a first side of said cabinet toward a second side of said cabinet;

c) means in said cabinet for moving individual print media sheets from the top of a stack of sheets in said tray toward said second side of said cabinet;

d) a convex print media guide moveable between an operative position in which said guide extends upwardly from said cabinet and an open position in which said convex guide extends generally in the direction of movement of said print media tray, said guide being movably connected to said cabinet proximate said second side of said cabinet;

e) a print media guide housing moveable between an operative position in which said housing extends upwardly from said cabinet and an open position in which said housing extends generally in the direction of movement of said print media tray, said housing being movably connected to said cabinet at said second side, said housing having a concave print media guide surface therein spaced from said convex print media guide, said convex guide and said concave housing surface, when in operative position, defining a curved print media path therebetween terminating at a discharge end, said housing substantially enclosing said print media guide;

f) means for moving individual sheets of print media along said print media path; and g) a print media pre-heater affixed to one of said guide and said housing proximate said print media discharge end.

2. The apparatus of claim 1, wherein said first side of said cabinet is the front side of said cabinet and said second side is the rear side of said cabinet.

3. The apparatus of claim 2, wherein said upper surface of said cabinet is substantially horizontal and includes indexing means for positioning and supporting a printer thereon.

4. The apparatus of claim 3, wherein said discharge end of said media path is oriented to discharge print media generally horizontally from said path toward said front of said cabinet.

5. The apparatus of claim 4, wherein said convex print media guide is pivotally affixed to said cabinet for movement about a first pivot axis.

6. The apparatus of claim 5, wherein said housing is pivotally affixed to said cabinet for movement about a second pivot axis, said second axis being located below and to the rear of said first axis.

7. The apparatus of claim 6, wherein said pre-heater is affixed to said convex print media guide.

8. The apparatus of claim 7, wherein said pre-heater comprises an electrical resistance heater.

9. The apparatus of claim 8, wherein said means for moving comprise a powered media drive roller mounted on said convex print media guide.

10. The apparatus of claim 9, further comprising a media pinch idler roller mounted on said housing in opposed relation to said powered media drive roller.

* * * * *